United States Patent [19]

Hatcher

[11] 4,109,917

[45] Aug. 29, 1978

[54] TRUCKING GAME

[76] Inventor: Sheila Starr Hatcher, 9434 Palmetto La., Shreveport, La. 71108

[21] Appl. No.: 659,282

[22] Filed: Feb. 19, 1976

[51] Int. Cl.[2] ..... A63F 3/04

[52] U.S. Cl. ..... 273/254

[58] Field of Search ..... 273/134

[56] References Cited

U.S. PATENT DOCUMENTS

| | | | |
|---|---|---|---|
| 469,089 | 2/1892 | Parker | 273/134 AC |
| 952,997 | 3/1910 | Sanderson | 273/134 AC |
| 1,348,335 | 8/1920 | Thompson | 273/134 AC |
| 3,658,337 | 4/1972 | Peters et al. | 273/134 AC |

FOREIGN PATENT DOCUMENTS

| | | | |
|---|---|---|---|
| 525,521 | 8/1940 | United Kingdom | 273/134 AC |
| 922,772 | 4/1963 | United Kingdom | 273/134 C |

*Primary Examiner*—Richard C. Pinkham
*Assistant Examiner*—Harry G. Strappello
*Attorney, Agent, or Firm*—John M. Harrison

[57] ABSTRACT

A game simulating trucking activities with use of simulated Citizens Band Radio (CB) communications and chance in traversing a game board. Truck loads are carried from east to west and west to east across a game board simulating the continental USA and sequential advancement is made by throwing dice or using a spinner.

6 Claims, 6 Drawing Figures

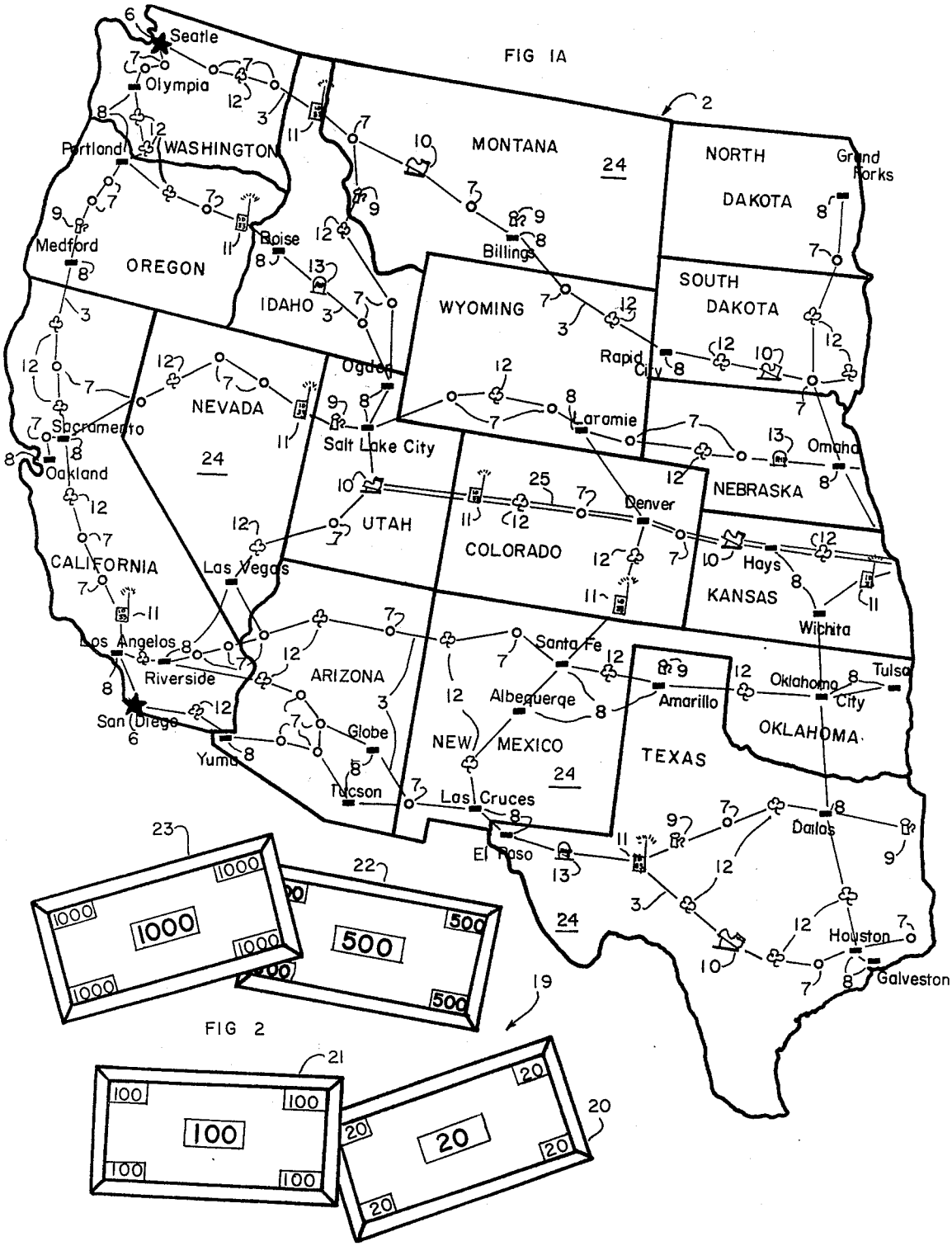
FIG 1A
Seatle
Olympia
WASHINGTON
Portland
Medford
OREGON
Boise
IDAHO
MONTANA
24
Billings
NORTH
DAKOTA
Grand Forks
SOUTH
DAKOTA
Rapid City
WYOMING
Laramie
Ogden
NEVADA
24
Salt Lake City
Sacramento
Oakland
CALIFORNIA
Los Angelos
Riverside
San Diego
Las Vegas
UTAH
COLORADO
Denver
NEBRASKA
Omaha
Hays
KANSAS
Wichita
ARIZONA
Yuma
Globe
Tucson
Santa Fe
Albequerqe
NEW MEXICO
24
Las Cruces
El Paso
Amarillo
TEXAS
Oklahoma City
Tulsa
OKLAHOMA
Dallas
Houston
Galveston
24
1000
500
FIG 2
100
20

FIG 3
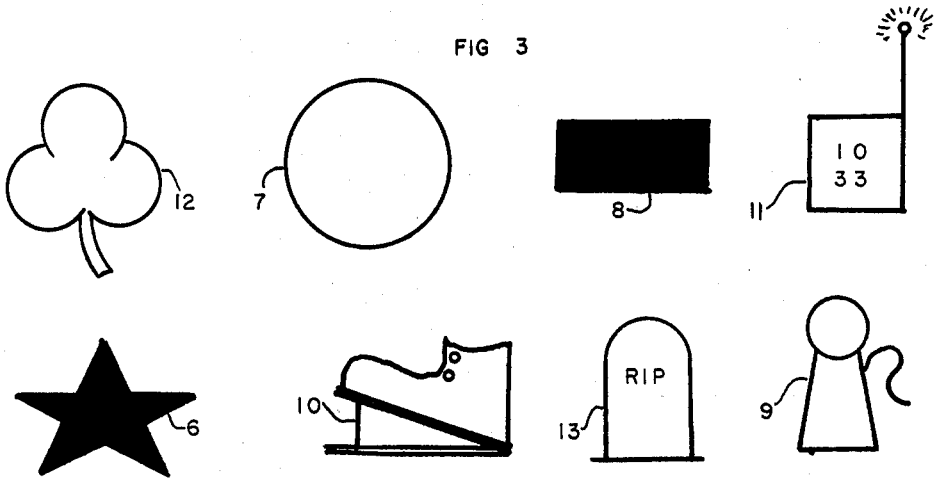
FIG 4
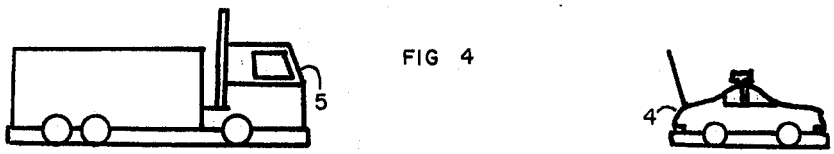
ST LOUIS, MO.
TO
GLOBE, ARIZ.
HANDLE: SUPER SPORT
FREIGHT: 1 ROCK WAGON
RATE: $ 2020
CONVOY: $ 2420
14
CONGRATULATIONS! YOU HAD ENOUGH MONEY TO PAY YOUR INCOME TAX. KEEP $ 500. GIVE THE REST TO INTERNAL REVENUE.
16
FIG 5
17
SMOKEY DOING FLIP FLOPS AND TAKING PICTURES. SLOW TO DOUBLE NICKLES. USE ONE DICE ON NEXT ROLL.
PARACHUTE JUMPER LANDS ON THE HIGHWAY IN FRONT OF YOUR RIG. GO BACK 3 SPACES.
15
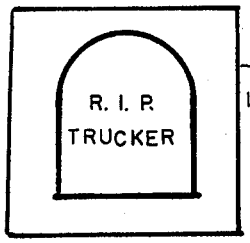
18
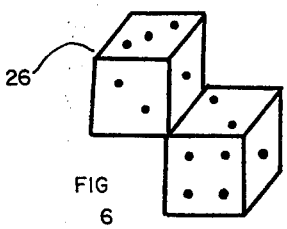
FIG 6

TRUCKING GAME

BACKGROUND OF THE INVENTION

Field of the Invention

This invention relates to a new trucking game, and more particularly, to a game having as an object the advancement of trucks carrying loads across a game board simulating the continental USA along interstate highway systems according to chance. The game makes use of Citizens Band Radio (CB) terminology and procedure, and is intensified by various instruction cards keyed to route locations and the activities of a state trooper (Smokey) stationed along the interstate truck routes and capable of terminating the advancement of the trucks.

Accordingly, it is an object of this invention to combine the enjoyment of a progressive game of chance with the excitement of the Citizens Band Radio terminology and procedure in a trucking game.

Another object of the invention is to provide a game which is characterized by advancement of tokens across selected truck routes of the USA according to chance, with random instructions to players provided by means of specific locations on the routes and a series of instruction cards which are used as directed on other specific truck route locations.

Yet another object of the invention is to provide a trucking game which includes the terminology and procedure of Citizens Band Radio (CB) communication.

A still further object of this invention is to provide a game of chance which utilizes a playing board and alternate routes which can be selectively traversed by the players to introduce an element of skill into the game.

Another object of the invention is to provide a stimulating game which simulates moving trucks across the USA according to the throws of dice or turns of a spinner and instructions keyed to route locations, and which also encourages use of Citizens Band Radio (CB) terminology and procedures.

SUMMARY OF THE INVENTION

These and other objects of the invention are provided in a trucking game incorporating a playing surface upon which is superimposed a layout of the continental USA with selected interstate routes outlined thereon, and various symbols noted at selected locations along these routes. Some of these symbols represent instructions which must be followed, while others are keyed to player instruction cards drawn as the routes are traversed. Player advancement along the routes selected in the game depends upon chance as dice are thrown or a spinner activated in each turn, and the object of the game is to deliver as many loads from given points of departure to designated points of destination as possible without being caught by the state trooper or "Smokey" in the course of traversing the routes.

BRIEF DESCRIPTION OF THE DRAWINGS

The invention will be better understood in view of the following description presented with reference to the accompanying drawings.

FIGS. 1A and 1B of the drawings are collectively a plan view of the game board of this invention illustrating the continental USA with selected interstate highway routes and particular points on these routes having certain symbols which are keyed to player instructions;

FIG. 2 is a view of the play or scrip money used in the game, on denominations of 20, 100, 500 and 1000 dollars;

FIG. 3 is a view of the preferred various symbols used at selected points on the game board routes;

FIG. 4 is a side elevation of the patrol (Smokey) car and truck miniatures using as the playing tokens;

FIG. 5 is a view of representative load cards, 1033 (emergency) cards, truckers' luck cards and deadhead cards which provide instructions to players as the game progresses; and FIG. 6 is a perspective view of dice used in a preferred embodiment of the invention to sequentially advance the players along selected routes in the game according to chance.

DESCRIPTION OF THE PREFERRED EMBODIMENTS

Figure 1B:
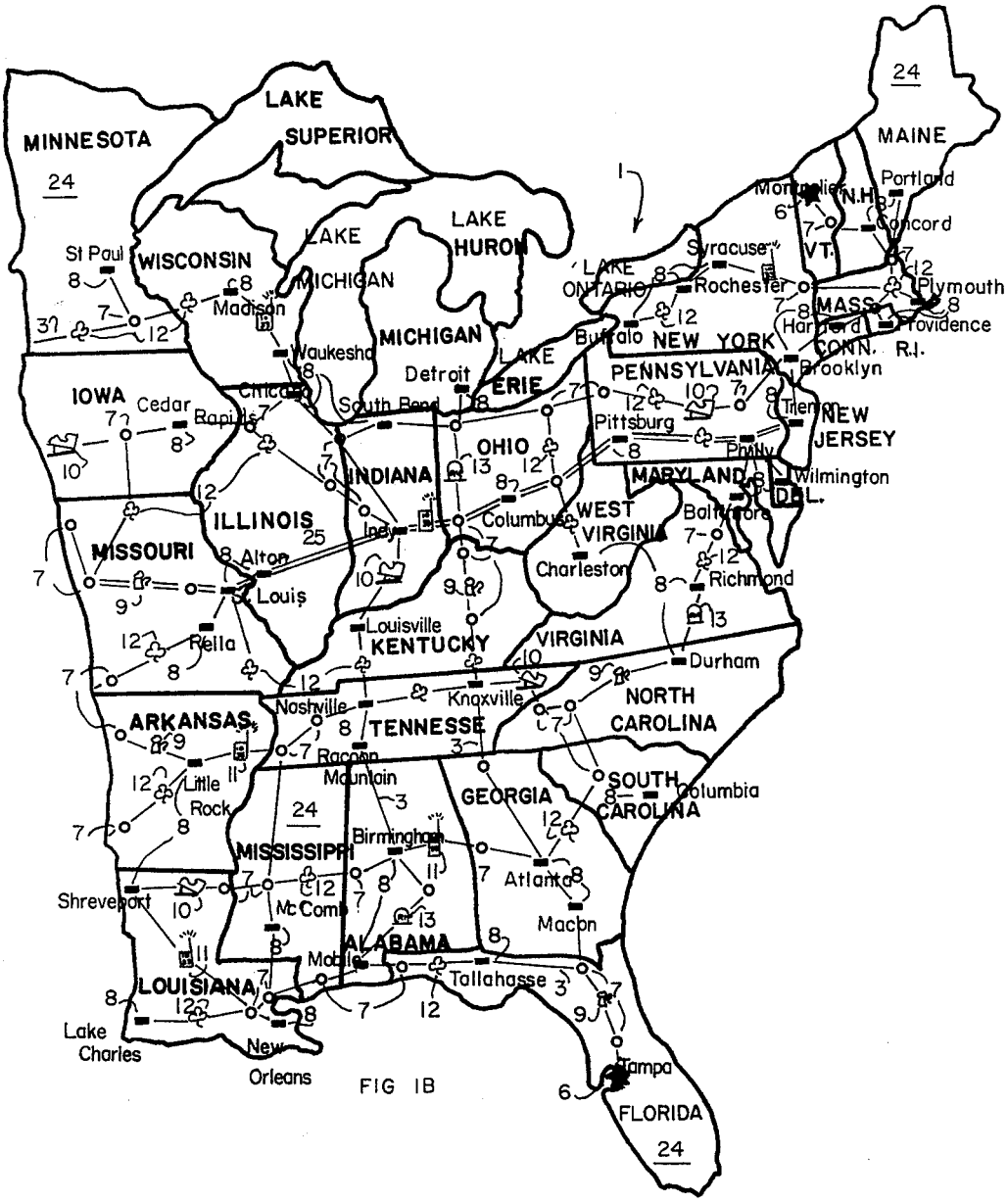

Referring to FIGS. 1 and 3 of the drawings, game board 1 is illustrated, upon which USA map 2 has been superimposed, with interstate highway systems 3 and states 24 inscribed thereon. Various game symbols, such as smokey headquarters 6, rest stops 7, truck terminals 8, fuel stops 9, "let th hammer down" locations 10, emergency locations 11, truckers' luck locations 12 and deadhead locations 13, particularly illustrated in FIG. 3, are selectively positioned along the respective routes of interstate highway systems as shown. Interstate highway 70, represented by reference numeral 25, is the highway dividing USA map 2 into northern and southern sections for game purposes.

Referring now to FIGS. 1, 3 and 5, each of the game symbols, including fuel stops 9, "let the hammer down" locations 10, emergency locations 11, truckers' luck locations 12, and deadhead locations 13 are keyed to instructions for game players. For example, when, during the course of the game a player lands on an emergency location 11, he must draw an emergency (1033) card 15, for instructions. As illustrated in FIG. 5 of the drawing, the emergency (1033) card 15 instructs the player to go back 3 spaces. Ten such cards are provided for use in the game, it being understood that the emergency (1033) card 15 illustrated in FIG. 5 of the drawing is merely illustrative, and is not inclusive of all of the instructions included in such cards, and when the top card of the group is pulled, it is reinserted on the bottom of the stack. A list of preferred emergency (1033) cards is as follows:

1. Hundred mile coffee only good for fifty miles. Advance to nearest town.
2. Friend needs help. Go directly to Tucson.
3. Bridge out. Roll again and turn left at next intersection.
4. You have run out of fuel. Flip flop to nearest fuel stop and pay.
5. Parachute jumper lands on highway in front of your rig. Go back 3 spaces.
6. Accelerator stuck. Go forward 5 spaces.
7. Just learned spouse is suing for divorce. Return to point of origin on Load Card.
8. Reefer blowing hot. Frozen chickens coming to life. Hide from Terminal Manager. Move Truck directly to Raccoon Mountain.
9. Truck jackknifed. Pay $500 — cargo damage, $100 — tow truck charge, $20 — aspirin and coffee. Total due — $620.

10. Not enough green stamps for toll road. Go back to nearest intersection and turn either direction.

Similarly, when a player lands on a truckers' luck location 12, he must take a truckers' luck card north 16, or a truckers' luck card south 17, as illustrated in FIG. 5, depending upon whether he is traveling a route north or south of interstate highway 70, represented by reference numeral 25 on USA map 2. If the player is traveling on interstate highway 70 (reference numeral 25) he may choose from either group of truckers' luck cards. The truckers' luck card north 16, or truckers' luck card south 17, instructs the player as illustrated in FIG. 5, and twenty two such cards are provided in each group. A list of preferred truckers' luck cards north and south, respectively, is as follows:

1. Little old lady bumps your truck. Little old lady wins law suit. Pay $800.
2. Get ptomaine poisoning from eating polish sausage at Cloud Nine Truck Stop. Costs you $100.
3. Stuck on Snow Shoe Mountain, Penn. Pay wrecker $100.
4. While drinking coffee at Big Ed's Truck Stop, TV casting director asks you to drive rig for a scene in film. Salary — $300.
5. Interstate #90 closed to trucks at Chicago town due to high winds. Move truck to South Bend, Ind.
6. Heavy spring snow. Buy snow chains. Pay $100.
7. Smokey has highway blocked due to spilled molasses on road from overturned rig. Go back to nearest intersection, roll again, turn right.
8. Overweight at chicken coop. Pay $100.
9. Blizzard — Highway closed. Go Back 4 spaces.
10. Leave truck at Omaha terminal and take bus to Ak-Sar-Ben Race Track. Lose at horse races. Pay $200.
11. Got to lose some weight to pass ICC physical exam. Skip lunch. Skip 5 spaces.
12. Log books not current. Pay ICC $100.
13. Snake River flood. Go back 3 spaces.
14. Find black bag on side of road outside Detroit. Collect $1000. P.S. Owner does not want to be found.
15. Enter Iowa hog calling contest. Win 3rd place. Win $100.
16. Smokey doing flip flops and taking pictures. Slow to double nickels. Use one dice on next roll.
17. You bet your trucker friends that its 2232 miles from Houston to Portland, Oregon. You lose. Pay each trucker $100. P.S. It is 2233 miles.
18. Sell two tarps to trucker at Teena's Truck Stop. Collect $100.
19. Beaver gives you a hard luck story. Pay $100.
20. Pull a 4-wheeler out of a ditch on Feather River Canyon road. Collect $100.
21. Win TV set at Sara Lou's Truck Stop. Sell TV for $300.
22. Illegal load. Freight confiscated by ICC. Turn in Load Card. You must remain where you are and deadhead to point of origin on next Load Card.
1. You didn't know an illegal alien was hiding under a tarp. Spend night in Yuma Prison. Miss 1 turn or pay $200 bond.
2. Chased by Tijuana taxi. Advance 2 spaces and pay $200 fine.
3. Galveston Ferry out of operation. Return to crossroads and detour.
4. Truck pulled over bits at California Port of Entry. Smoke eliminator required. Pay $200.
5. Purchase turquoise and silver squash blossom necklace from old Indian. Pay $240.
6. Kansas City black and white makes you pay green stamps for not being on truck route. Pay $200.
7. CB set breaks down. Smokey gets you. Pay $200.
8. Your ears aren't working. Repairs cost $80.
9. Leave truck at El Paso Terminal. Take bus to Juaraz and lose at dog races. Pay $200.
10. Desert land ahead. Let the hammer down. Skip 3 spaces.
11. Sell turquoise and silver squash blossom necklace to trading post. Collect $450.
12. Recognize and report F.B.I. wanted skyjacker. Reward $1000.
13. Hit two Texas deer. Radiator damaged. Pay $500.
14. Truck pitted by sand storm. Get truck painted. Pay $400.
15. Collision of a 4-wheeler and an 18-wheeler blocking highway. Put in a call for Smokey. Go back 3 spaces.
16. Desert sandstorm. Highway closed. Go back to last cross-roads and go a different route.
17. Congratulations! You had enough money to pay your income tax. Keep $500. Give rest to Internal Revenue.
18. Stop for a CB Trucker Coffee Break to meet Salty Dog, Super Spook, and Ramblin' Rose. Miss 1 turn.
19. The space in between your two front teeth helped you win 1st place in an Alabama watermelon spitting contest. Collect $100.
20. A 4-wheeler crashes into the Mississippi River. You rescue the drowning driver who rewards you. Collect $1000. P.S. You didn't want a reward, but he forces you to accept.
21. Night on town at French Quarter in New Orleans. Pay $150.
22. Highway Use Tax due. Pay $250.

In like manner, if a player lands on a deadhead location 13, he must pull the top card 18, of six such cards in a stack, the function and use of which will be hereinafter described. If, on the other hand, a player lands on a rest stop 7, he simply remains in that position until his next turn.

Enjoyment of the game is enhanced by use of the following CB terminology or "trucker talk" while playing:

Let the hammer down — Put your foot on the accelerator and GO
Chicken Coop — State weight scales
Beaver — Girl
Smokey — State Trooper
Bear — Police
County Mounty — Sheriff
Green Stamps — Money (usually to pay ticket)
Taking pictures — Using radar
Flip-Flop — Changing directions on highway (backtracking)
Double Nickels — 55 mph
Ears — CB set
4-wheeler — car
100 mile Coffee — Coffee strong enough to last 100 miles.
Reefer — Refrigerated trailer
ICC — Interstate Commerce Commission which regulates trucking
Deadhead — moving unloaded rig
18-wheeler or Rig — Semi-Truck
Black and White — Local police car
Tijuana Taxi — Border Patrol Referring now to FIG. 2 of the drawing, $2000 in paper money or scrip 19, is issued to each player prior to initiating play, in denominations of twenties 20, one hundreds 21, five hundreds 22, and one thousands 23, in accordance with rules hereinafter set forth. It will be appreciated that the initial issuance of paper money or scrip 19 in the amount of $2000 is a preferred amount for beginning the game; however, alternative quantities may be issued at the start of the game in the discretion of the players.

The number of players which may participate in the game is not fixed, although from four to six players is preferred. Referring to FIGS. 4 and 5 of the drawings, one player uses a Smokey car 4, and the rest of the players each use a truck 5 as tokens to traverse game board 1 in the manner hereinafter described. The game has as its object traversal of USA map 2 on game board 1 by a truck 5 from departure terminals to destination terminals, represented by reference numerals 8, to deliver the maximum number of loads possible until all loads have been delivered. Traversal of game board 1 is accomplished by chance in accordance with the throws of dice 26 illustrated in FIG. 5 or by alternative means such as a spinner, and the player with the highest number of delivered loads wins.

The game is played as follows: Game board 1 is placed on a table, trucker's luck coards north 16, are placed in a stack on the northern border of USA and trucker's luck cards south 17, on southern border. Each player is given $2000 (one $1000 bill, one $500 bill, and five $100 bills). One of the players is chosen Terminal Manager, who is in charge of transacting the game business, including handling all financial transactions.

One of the players serves as Smokey at all times, and the rest of the players are truckers. Each player initially throws dice 26, and the player with the lowest number becomes Smokey. This player then places Smokey car 4 on a selected Smokey headquarters 6; the cities Montpelier, Vermont; Tampa, Florida; Seattle, Washington; and San Diego, California, are marked on game board 1 as Smokey headquarters 6. It is Smokey's job to catch the truckers, and he does this by landing by exact count of dice 26 on a space occupied by a trucker. Smokey can change direction on interstate highway system 3 and interstate highway 70 (reference numeral 25) at will ("flip-flop") and never receives a penalty for landing on any of the symbols on USA map 2. After Smokey has caught a trucker, he takes over the trucker's rig and load, (truck 5) and when his next turn comes, he chooses any interstate highway system 3 including interstate Highway 70 (reference numeral 25) he wishes, proceeds to finish delivering the captured load, and continues to operate as a trucker unless and until he is captured. When a trucker is captured by Smokey, the trucker then becomes Smokey, and when his turn comes, he places Smokey car 4 on a selected Smokey headquarters 6, and tries to capture other truckers. If a trucker lands on a location occupied by Smokey, he has been trapped and he loses the rig and load, (truck 5) and becomes Smokey, as described above.

In order to initially become a truck Owner-Operator (trucker), a player must first roll a "7" on the dice. After two unsuccessful turns, the player may, if he wishes, pay $500 for right-of-load and legalization rights. After shooting a "7" or paying $500, the player then receives one truck 5. He then takes the top load card 14 in a stack of 40 load cards, as illustrated in FIG. 5, and places his truck 5 on a truck terminal 8 designated by the load card 14 where the load is picked up. If the trucker has paid for the load, he may move his truck 5 the number of spaces shown on dice 26. If he has thrown a "7", he must keep his truck 5 on the designated pickup truck terminal 8 until his next turn. On succeeding turns the trucker proceeds to haul his load along a route which he selects from origin to destination by throwing dice and moving the number of spaces shown on dice. It will be appreciated that load car 14 illustrated in FIG. 5 of the drawing is illustrative of all such cards used in the game, which provide such information as a "handle", or a nickname when transmitting on a CB set, and while the trucker is pulling a load of freight, he uses the handle given for each separate load card. Each load card 14 also provides such information as the origin and destination terminal of the shipment, the type of freight hauled, and the ordinary and convoy rates received when the load is delivered.

If a trucker lands on a space occupied by another truck 5 moving in any direction, a collision occurs. The trucker at fault may pay $500 to the Terminal Manager for cargo damage, and must also pay $2000 to the trucker occupying the location at which the collision occurs. The trucker who is hit must pay $500 for cargo damage, and both trucks must remain in the same location until each respective next turn.

If the trucker lands on a "let the hammer down" location 10, he must advance his truck 5 three spaces, and if his new position is within three spaces of a terminal 8 of destination, he may unload. If at any time he lands on a fuel stop 9 he must pay a fuel charge of $100.00. If the trucker lands on a deadhead location 13, he must take a deadhead card 18 from the stack, turn in his load card 14, with no payment for the load, draw a new load card 14, and proceed to the terminal 8 designated as a departure point, in unloaded condition. He must then turn in his deadhead card 18, and proceed to the designated terminal 8 of destination.

In order to unload at each destination, each trucker must throw the exact number on either one or both dice to land on a terminal 8 specified on his respective load card 14 as the destination terminal. If the number rolled is greater than the spaces required to reach the destination, the trucker must go past the destination to the proper location. Only Smokey can do flip-flops, so the trucker must continue in the same direction past the destination terminal until reaching an intersection. The trucker may then use any alternate route in order to unload. If the destination is on a deadend highway and the trucker has not rolled an exact number to move the required number of spaces to reach the prescribed terminal 8, the trucker must stay on the same location on succeeding turns until he rolls the exact number required. If it is possible on the number rolled to land on the destination, the trucker must do so no matter what the penalty (such as a collision or Smokey location) might be.

When a trucker has seven completed load cards 14 in his possession, he automatically becomes a convoy, and is not now required to roll "7" in order to get new load card 14, or to pay for a load. The trucker now receives the convoy rate on each load card 14 upon delivery of his load at the specified destination point. The truckers "keep on truckin" until all loads have been delivered, and the trucker with the highest number of delivered loads wins. If two or more truckers have the same number of completed load cards 14, the winner is the trucker in possession of the most money at the time in question. If during the game a trucker runs out of money he may forfeit one completed load card and receive $1000 at any time.

Having described my invention with the particularity set forth above, what is claimed is:

1. A trucking game comprising:

(a) a game board having a map of the continental United States outlined thereon and selected highway routes located on said map;

(b) a first set of symbols characterized by emergency locations, truckers' luck locations and deadhead locations and a second set of symbols characterized by rest locations, fuel stop locations, and "let the hammer down" locations applied to selected locations along said routes, said second set of symbols being keyed to general instructions for the players of said game;

(c) a set of instruction cards keyed to said first set of symbols whereby when one of said players locates on any one of said first set of symbols pursuant to playing said game, one of said instruction cards keyed to said one of said first set of symbols is taken and the instructions thereon followed by said one of said players;

(d) a set of load cards for determining departure and destination locations for travel along said routes;

(e) a plurality of tokens for marking the progress of said players sequentially traversing said routes pursuant to chance; and (f) means for advancing said tokens along said routes according to chance.

2. The trucking game of claim 1 further comprising play money in selected denominations for effecting financial transactions in said game.

3. The trucking game of claim 1 further comprising a selected interstate highway separating the northern part of said map from the southern part of said map for purposes of said game.

4. The trucking game of claim 1 further comprising:

(a) play money in selected denominations for effecting financial transactions in said game; and (b) a selected interstate highway separating the northern part of said map from the southern part of said map for purposes of said game.

5. The trucking game of claim 1 wherein said highway routes are selected interstate highway systems running generally east and west on said map.

6. The trucking game of claim 1 wherein said tokens are in the shape of a miniature automobile simulating "Smokey" and miniature trucks, and said means for advancing said tokens along said routes according to chance is a pair of dice.

* * * * *